US005413059A

United States Patent [19]

Schips

[11] Patent Number: 5,413,059

[45] Date of Patent: May 9, 1995

[54] DEVICE FOR FEEDING PRODUCTS TO BE SEWN, IN PARTICULAR HAVING EDGES WHICH ROLL INWARD

[75] Inventor: Helmut Schips, Tuebach, Switzerland

[73] Assignee: Schips AG Naehautomation, Teubach, Switzerland

[21] Appl. No.: 25,676

[22] Filed: Mar. 3, 1993

[30] Foreign Application Priority Data

Mar. 6, 1992 [DE] Germany ..... 42 07 183.6

[51] Int. Cl.[6] ..... D05B 27/00; B65H 23/04

[52] U.S. Cl. ..... 112/308; 226/196; 112/136

[58] Field of Search ..... 38/143; 112/136, 308, 112/153, 303, 260; 226/196, 200; 26/51, 87, 88

[56] References Cited

U.S. PATENT DOCUMENTS

| | | | |
|---|---|---|---|
| 2,133,225 | 10/1938 | Goodwin . | |
| 2,508,096 | 5/1950 | Borgos . | |
| 3,436,853 | 4/1969 | Buss | 38/143 |
| 3,474,553 | 10/1969 | Moore, Sr. | 38/143 |
| 4,217,682 | 8/1980 | Young, Jr. . | |
| 4,928,610 | 5/1990 | Akutsu | 112/153 |

FOREIGN PATENT DOCUMENTS

| | | |
|---|---|---|
| 749.679 | 7/1933 | France . |
| 2363837 | 6/1975 | Germany . |
| 3805029C1 | 8/1989 | Germany . |
| 3904385A1 | 8/1990 | Germany . |
| 3743281C2 | 11/1990 | Germany . |
| 269800 | 4/1927 | United Kingdom . |
| 345070 | 3/1931 | United Kingdom . |
| 91/05899 | 5/1991 | WIPO . |

*Primary Examiner*—Clifford D. Crowder
*Assistant Examiner*—Paul C. Lewis
*Attorney, Agent, or Firm*—Spencer, Frank & Schneider

[57] ABSTRACT

A device for feeding a product to be sewn to a sewing machine includes a guide element having a curved slide surface on which the product to be sewn is guided in a sliding manner in a direction toward a sewing point. The guide element further has a strip-shaped projection, fitted onto the curved slide surface, which includes an elongated unrolling edge arranged transversely or obliquely to a conveying direction of the product to be sewn, and which projects from the curved slide surface. The elongated unrolling edge defines an upper boundary of the strip-shaped projection on the curved slide surface of the guide element.

11 Claims, 3 Drawing Sheets

DEVICE FOR FEEDING PRODUCTS TO BE SEWN, IN PARTICULAR HAVING EDGES WHICH ROLL INWARD

BACKGROUND OF THE INVENTION

1. Field of the Invention

The invention relates to a device for feeding products to be sewn.

2. Background Information

Various devices have already been disclosed for aligning material edges while they are being fed to the sewing machine.

A sewing machine is described, for example, in DE 3,743,281 C2 for the controlled sewing of a band onto a tubular opening edge of an elastic product to be sewn, in which various precautions are provided for controlled displacement of the product to be sewn transversely to the feed direction.

Furthermore, a sewing machine having a tensioning device has been disclosed by DE 3,805,029 C1, which device allows the opening edge of a tubular workpiece to be aligned at a sewing point.

Additionally, a device emerges from DE 3,904,385 A1 for laterally aligning one or two material edges during sewing, which device is likewise distinguished by various constructional measures to implement the said lateral alignment.

All the publications cited relate to devices for aligning one or more material edges to solve various types of problems. However, none of these devices is capable of solving the frequently occurring problem resulting from the material edge rolling inward, in particular in the case of elastic materials.

When machining such a material having edges which roll inward, the full attention of an operator was therefore previously always required to ensure that the material edge was fed to the machining point in a flat and unrolled manner. Naturally, such a manual monitoring and correction of the work process results in a considerable delay and a rate of faults which is clearly reflected in the quality and production costs.

SUMMARY OF THE INVENTION

The invention is based on the object of providing a device for feeding products to be sewn, said products having edges which roll inward, in which device said edges are presented in an unrolled and flat manner when arriving at the sewing point.

This object is achieved in a device according to the invention by a guide element having an elongated unrolling edge which is arranged transversely or obliquely to a conveying direction of a product to be sewn and projects from a side surface.

Accordingly, before it arrives at the sewing point, the product to be sewn is passed over an unrolling edge of a slide surface disposed transversely or obliquely to the conveying direction.

When sliding the product to be sewn over the unrolling edge, the rolled-in edge of the product to be sewn is unrolled and placed on a slide surface in a taut and flat manner so that the material rests with a flat-lying and visible edge after the edge on the slide surface ahead of the sewing point. This obviates the need for manual intervention of an operator who, without this measure, would constantly have to take care that the material edge is fed to the sewing machine properly. In this manner, a largely automated sewing process is made possible.

Advantageous further developments and improvements of the device specified in the main claim are possible due to the measures described in the sub-claims.

It has proved to be particularly advantageous to implement the unrolling edge as the upper boundary of a flat, strip-shaped projection which is fitted onto the slide surface of the guide element. Such a projection can be fastened to any expediently shaped guide element in a relatively simple manner, for example by welding, soldering or bonding.

Of course, the height of the strip-shaped projection depends on the type of product to be sewn. In a relatively lightweight elastic material, such as is used, for example for T-shirts or underwear, a height of between 5 and 10 mm and a length of 15–20 cm is recommended. The precise dimensions of the strip-shaped projection and of the guide element are expediently adapted to the product to be machined in each case. In this case, in particular, the size of the circumference of the rolled-in edge is particularly significant.

Furthermore, it has been proved to be advantageous to mount the unrolling edge obliquely or transversely relative to the sliding direction of the product to be sewn. The angle $\alpha$ between the sliding direction of the product to be sewn and the unrolling edge should preferably range from 0° to 90°. A mean value of $\alpha \approx 45°$ has proved to be best-suited.

By means of this alignment, a force is exerted on the product to be sewn, which force counteracts the tendency shown by the product to be sewn to slip down from the guide element, due to its own weight, forwards in the direction of the operator, i.e. a force which acts transversely to the conveying direction of the product to be sewn and unrolls the edge. In this alignment of the unrolling edge, the oncoming rolled-in material edge is literally spread out. The unrolling edge presses from the inside against the rolled-in material edge. During the unrolling, the material edge is offset toward the side by this rolling process transversely to the conveying direction, but fed forwards in the conveying direction at the same time. As a result, an oblique unrolling edge according to the invention can rest against the material edge over a certain area in the area of the unrolling point since said material edge likewise has an oblique course when passing through this area due to the unrolling. Along this oblique course of the material edge, the latter is in a transition from the rolled-in state to the desired unrolled state.

In order that the product to be sewn can fit more snugly against the unrolling edge when passing over it, it has proved to be advantageous to incline the strip-shaped projection relative to the normal line of the slide surface. In this case, the angle between the normal line of the slide surface and the strip-shaped projection can be up to +60° or −60° depending on the structure of the material to be machined.

While good results were achieved in some materials using a smooth edge, in other materials the unrolling process of the material edge is enhanced by forming teeth on the unrolling edge of the strip-shaped projection. The tooth lying nearest to the material edge on the material side grips, so to speak, behind the almost unrolled material edge, unrolls the latter during the sliding process, on the one hand, in such a way that it comes to rest flatly on the slide surface located thereafter and, on the other hand, prevents the material edge from being rolled up again before it rests flatly on the slide surface in the said manner.

In order to avoid the teeth of the unrolling edge becoming hooked in the product to be sewn, a sawtooth-type construction of the teeth has proved to be expedient, the teeth being aligned toward the end of the unrolling edge projecting in the sliding direction. In this case, on the one hand the sliding process over the unrolling edge is facilitated while, on the other hand, the teeth of sawtooth-type construction strongly counteract renewed rolling-in of the material edge. Additionally, the teeth effectively inhibit the product to be sewn from slipping down from the guide element.

Of course, there is no obstacle to a combination of a device according to the invention with additional devices, such as an automatic material edge alignment, for example one of the devices mentioned at the beginning in the descriptions concerning the prior art. Additional construction elements, such as compressed air nozzles or the like, can also be integrated in the guide element itself, for example by means of cutouts mounted specifically for this purpose.

Furthermore, it is irrelevant whether a circumferential, closed-loop material edge of a tubular product to be sewn, for example a trouser waistband, or an open material edge, such as is found in webs of material, is machined using a device according to the invention.

BRIEF DESCRIPTION OF THE DRAWINGS

An advantageous and expedient exemplary embodiment of the invention is illustrated in the drawings and explained in detail in the following description.

DETAILED DESCRIPTION OF THE PREFERRED EMBODIMENTS

Figure 1:
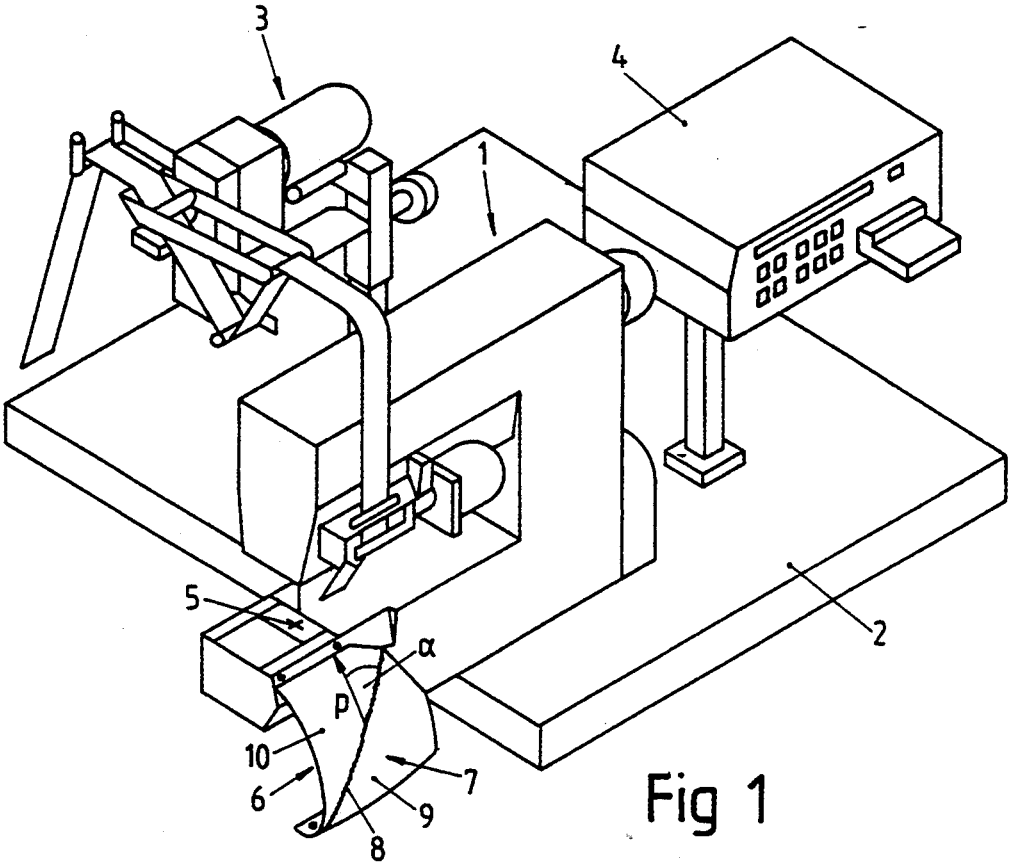
FIG. 1 shows a perspective of a device according to the invention on a sewing machine.

FIG. 1 shows a sewing machine 1 for industrial production which is mounted on a base plate 2. It is provided with an automatic band feed 3 and an electronic control 4. The sewing point 5 and the guide element 6 are located at the front point of the sewing machine 1. The visible surface of the guide element 6 constitutes its slide surface 7. The unrolling edge running obliquely over the slide surface is denoted by the reference numeral 8. The feed direction of a product to be sewn (not illustrated) in the direction toward the sewing point 5 is marked by an arrow P on the slide surface 7. The angle $\alpha$ is indicated between the feed direction P and the unrolling edge 8. The unrolling edge 8 is arranged in such a way that the angle $\alpha$ between sliding direction P of the product to be sewn and unrolling edge 8 is between 0°–180°, and preferably between 0°–90°.

The product to be sewn (not illustrated) is placed with its edge over the slide surface 7 with the unrolling edge 8, attention being drawn to the fact that the part of the material edge located between the sewing point 5 and the unrolling edge 8 has already been unrolled and lies in a flatly taut manner. When the material edge is sewn, the sewing machine 1 pulls the product to be sewn automatically over the slide surface 7 of the guide element 6, the material edge, which is rolled inward in the lower part of the slide surface 9 being unrolled on the unrolling edge 8 so that it comes to rest in a flat and easily machinable manner on the upper part 10 of the slide surface. For reasons of clarity, the illustration of additional apparatuses which are necessary for a largely automated sewing process has been dispensed with in FIG. 1 apart from the automatic band feed 3.

Figure 2:
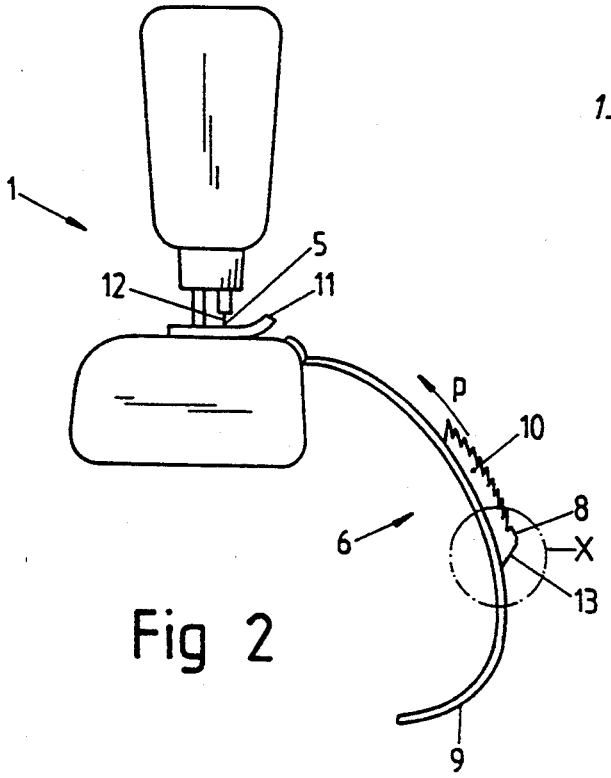
FIG. 2 shows a front elevation of a device according to the invention with a sewing machine indicated.

FIG. 2 shows the front elevation of a sewing machine 1 with a guide element 6 according to the invention mounted thereon. The product to be sewn (not illustrated) is fed in the direction of the arrow P over the guide element 6 to the sewing point 5, the foot 11 and needle 12 of the sewing machine 1 being visible in FIG. 2. The guide element 6 is constructed as a curved guide surface 9,10, preferably approximately circular in cross-section, the mean radius of curvature in the area of the unrolling edge 8 being in the order of magnitude of 10 cm.

Figure 3:
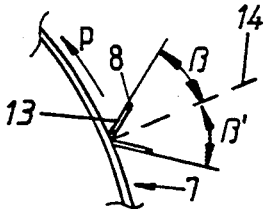
FIG. 3 shows an extract "X" from FIG. 2 which, in particular, shows a front elevation of the unrolling edge.

The encircled extract "X" in FIG. 2 with a short extract of the strip-shaped projection 13 and the unrolling edge 8 is illustrated in an enlarged manner in FIG. 3. In this case, the angle $\beta$, $\beta'$ between the normal line 14 of the slide surface 7 and the strip-shaped projection 13 with the unrolling edge 8 is indicated. Relative to the normal line, this angle can assume negative ($\beta$) or positive ($\beta'$) values, preferably between $-60°$ and $+60°$. Such an inclination of the strip-shaped projection 13 in the direction toward the slide surface 7 has proved to be expedient in respect of improved sliding or unrolling characteristics of the material edge. The unrolling edge 8 constitutes an upper boundary of strip-shaped projection 13 (which may be flat) fitted onto slide surface 7 of guide element 6.

Figure 4:
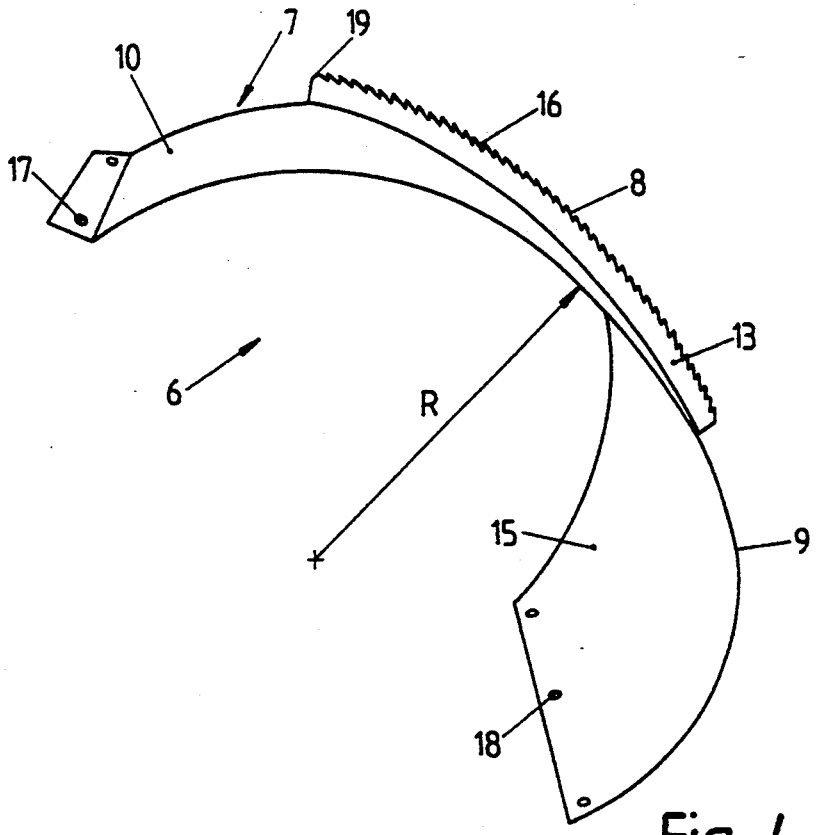
FIG. 4 shows a perspective front elevation of an object according to the invention.
Figure 6:
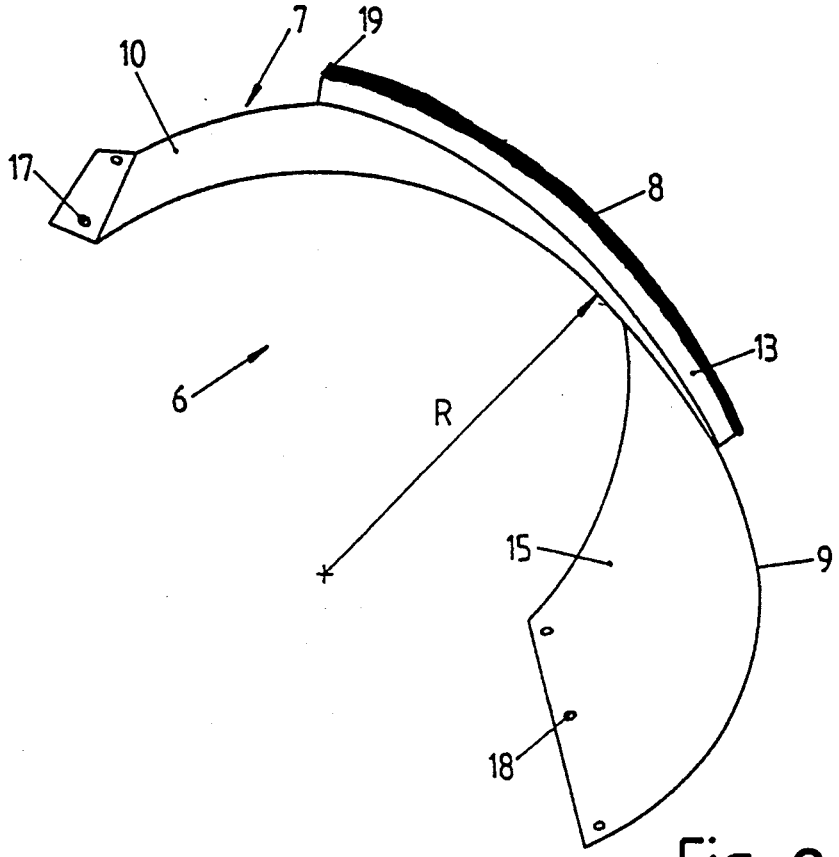
FIG. 6 shows an alternate embodiment with a smooth strip-shaped projection.

FIG. 4 shows a perspective from the front of an object according to the invention. Apart from the slide surface 7 with its lower part 9 and upper part 10, the underside 15 of the guide element 6 is also illustrated in this case. Furthermore, the strip-shaped projection 13 with the unrolling edge 8 is illustrated. The sawtooth-type teeth 16 of the unrolling edge 8 can be seen particularly well in this illustration. Additionally, the guide element 6 has upper mounting bores 17 and lower mounting bores 18 for fastening to its respective site of application. The mean radius of curvature of the guide body 6 is marked as R. The unrolling edge 8 of strip-shaped projection 13 may alternately be smooth (see FIG. 6).

The teeth 16 of the unrolling edge 8 pointing toward the sewing machine on the one hand improve the unrolling characteristics of a material edge which is pulled over it and counteract any slipping-down of the material from the unrolling edge 8 and thus also from the overall guide element 6. In conjunction with the position of the strip-shaped projection 13, bent at the angle $\alpha$, relative to the conveying direction P of the material and with the sliding movement of the latter, the teeth 16 of the unrolling edge 8 exert a transverse force on the material lying thereon, which force counteracts the tensile force of its own weight directed toward the operator. In this manner, improved adherence of the material on the guide element 6 is provided. The sawtooth-type design of the teeth 16 enhances the sliding of the material in the conveying direction P and again reinforces its adherence on the guide element 6. The sawtooth-type teeth 16 of strip-shaped projection 13 are aligned toward end 19 of unrolling edge 8 projecting in sliding direction P.

Figure 5:
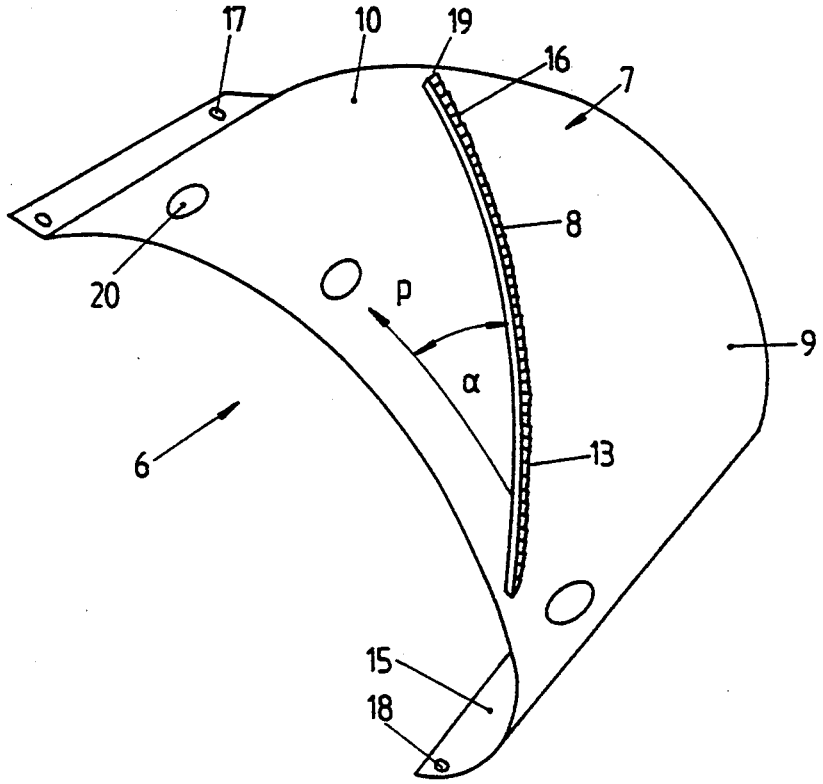
FIG. 5 shows a perspective of a view from obliquely above onto a device according to the invention.

FIG. 5 again shows a perspective illustration of an object according to the invention viewed from obliquely above. In contrast to FIG. 4, in this case the position of the strip-shaped projection 13 and thus also of the rolling edge 8, bent at the angle $\alpha$, relative to the sliding direction P of the material can be seen. As already explained above, this position of the unrolling edge 8 not only improves its unrolling characteristics, but also enhances the sliding of the material in the conveying direction P and, at the same time, inhibits the material from slipping down forwards from the guide element 6. The bores 20, shown additionally in this figure, can receive additional construction elements, such as compressed air nozzles or the like.

I claim:

1. A device for feeding products to be sewn to a sewing apparatus, the device comprising:

a guide element having a curved slide surface on which the product to be sewn is guided in a sliding manner a direction toward a sewing point, wherein the guide element further has a strip-shaped projection, fitted onto the curved slide surface, which includes an elongated unrolling edge arranged one of: transversely and obliquely to a conveying direction of the product to be sewn, and which projects from the curved slide surface;

wherein the elongated unrolling edge defines an upper boundary of the strip-shaped projection on the curved slide surface of the guide element; and wherein the unrolling edge of the strip-shaped projection is provided with teeth.

2. The device as claimed in claim 1, wherein the unrolling edge is arranged so that an angle $\alpha$ between a sliding direction of the product to be sewn and the unrolling edge is between 0°–180°.

3. The device as claimed in claim 1, wherein the unrolling edge is arranged so that an angle $\alpha$ between a sliding direction of the product to be sewn and the unrolling edge is $\approx$45°.

4. The device as claimed in claim 1, wherein the strip-shaped projection is inclined at an angle from a normal to the slide surface.

5. The device as claimed in claim 4, wherein the inclination angle between the strip-shaped projection and the normal to the slide surface is between −60° and +60°.

6. The device as claimed in claim 4, wherein the strip-shaped projection is inclined toward a sliding direction of the product to be sewn relative to the normal to the slide surface.

7. The device as claimed in claim 1, wherein the teeth are of sawtooth-type construction, are aligned toward an end of the unrolling edge and project in a sliding direction of the product to be sewn.

8. The device as claimed in claim 1, wherein the elongated unrolling edge of the strip-shaped projection is smooth.

9. The device as claimed in claim 1, wherein the guide element further has a curved guide surface with a mean radius of curvature in the region of the unrolling edge being approximately 10 cm.

10. The device as claimed in claim 9, wherein the curved guide surface is approximately circular in cross-section.

11. A sewing machine comprising means for sewing a product at a sewing point and having a device for feeding a product to be sewn thereto, wherein the device for feeding comprises:

a guide element having a curved slide surface on which the product to be sewn is guided in a sliding manner toward the sewing point of the sewing machine;

a strip-shaped projection, fitted onto the curved slide surface of the guide element, which includes an elongated unrolling edge arranged one of: transversely and obliquely to a conveying direction of the product to be sewn, and which projects from the curved slide surface;

wherein the elongated unrolling edge defines an upper boundary of the strip-shaped projection on the curved slide surface of the guide element; and wherein the unrolling edge of the strip-shaped projection is provided with teeth.

* * * * *